US005933889A

United States Patent [19]

Eekhoff

[11] Patent Number: 5,933,889

[45] Date of Patent: Aug. 10, 1999

[54] MORTUARY COT POST TIP

[75] Inventor: David L. Eekhoff, Sioux Center, Iowa

[73] Assignee: Link Mfg., Ltd., Sioux Center, Iowa

[21] Appl. No.: 08/937,493

[22] Filed: Sep. 25, 1997

[51] Int. Cl.[6] ..... A61G 1/02

[52] U.S. Cl. ..... 5/611; 296/20; 248/188.9; 403/370

[58] Field of Search ..... 296/20; 248/632, 248/677, 188.9; 403/227, 225, 370; 135/77, 86, 84, 82; 5/611, 110, 620, 600, 310, 663; 16/42 R

[56] References Cited

U.S. PATENT DOCUMENTS

| | | | |
|---|---|---|---|
| 1,120,410 | 12/1914 | Rohmer et al. | 403/370 X |
| 2,513,193 | 6/1950 | Miller | 248/188.9 |
| 2,517,443 | 8/1950 | Rhodes et al. | 296/20 X |
| 2,520,757 | 8/1950 | Cain | 248/632 |
| 2,841,438 | 7/1958 | Weil | 296/20 |
| 2,877,047 | 3/1959 | Weil | 296/20 |
| 2,877,048 | 3/1959 | Weil | 296/20 |
| 3,826,528 | 7/1974 | East | 296/20 |
| 4,097,939 | 7/1978 | Peck et al. | 5/611 |
| 5,537,704 | 7/1996 | Dinkler | 5/643 X |
| 5,782,256 | 7/1998 | Bradley | 135/84 X |
| 5,810,380 | 9/1998 | Lin | 403/370 X |
| 5,865,204 | 2/1999 | Bracy | 135/82 |

*Primary Examiner*—Michael F. Trettel
*Assistant Examiner*—Robert G. Santos
*Attorney, Agent, or Firm*—Zarley,McKee,Thomte, Voorhees & Sease; Dennis L. Thomte

[57] ABSTRACT

A post tip is provided for a mortuary cot. The post tip comprises a cup-shaped member including a bottom portion and a cylindrical wall surface extending upwardly therefrom. An elongated bolt extends upwardly through the lower end of the cup-shaped member and extends through a deformable cylindrical plug. The upper end of the bolt is threadably received by a plug compression member. When the tip is installed on the cot post, the cylindrical wall surface of the cup-shaped member embraces the lower end of the cot post and the cylindrical plug is received in the interior of the cot post. Threadable rotation of the bolt causes the plug to be deformed and expanded outwardly into engagement with the interior wall surface of the cot post. The Delrin construction of the cup-shaped member ensures that the lower end of the cot post will not cut or wear therethrough.

8 Claims, 3 Drawing Sheets

MORTUARY COT POST TIP

BACKGROUND OF THE INVENTION

1. Field of the Invention

This invention relates to a mortuary cot post tip and more particularly to a mortuary cot post tip which may be easily installed on the lower end of the mortuary cot post and which will be long wearing.

2. Description of the Related Art

Mortuary cots are utilized to allow one or more persons to perform retrieval of a body. The cots normally include a horizontally disposed bed portion having a pair of folding legs which support the cot as the cot is being moved between the place of the retrieval and the mortuary vehicle. The folding legs of the cot are normally automatically foldable as the cot is moved into the vehicle. When the cot is placed in the vehicle and the legs have been folded, a pair of auxiliary wheels at the forward end of the cot support one end of the cot and a pair of downwardly extending posts are provided at the other end of the cot for supporting the cot in the vehicle. The downwardly extending cot posts normally have a rubber tip thereon which engaged a surface in the vehicle to prevent the cot from moving as the vehicle travels from the point of retrieval to the mortuary. The problem associated with the conventional cot post tips is that the cot posts tend to cut or wear through the tips with the exposed cot posts then causing damage to the supporting surface in the vehicle. The replacement of the prior art post tips becomes a constant, time consuming and expensive procedure.

SUMMARY OF THE INVENTION

Figure 1:
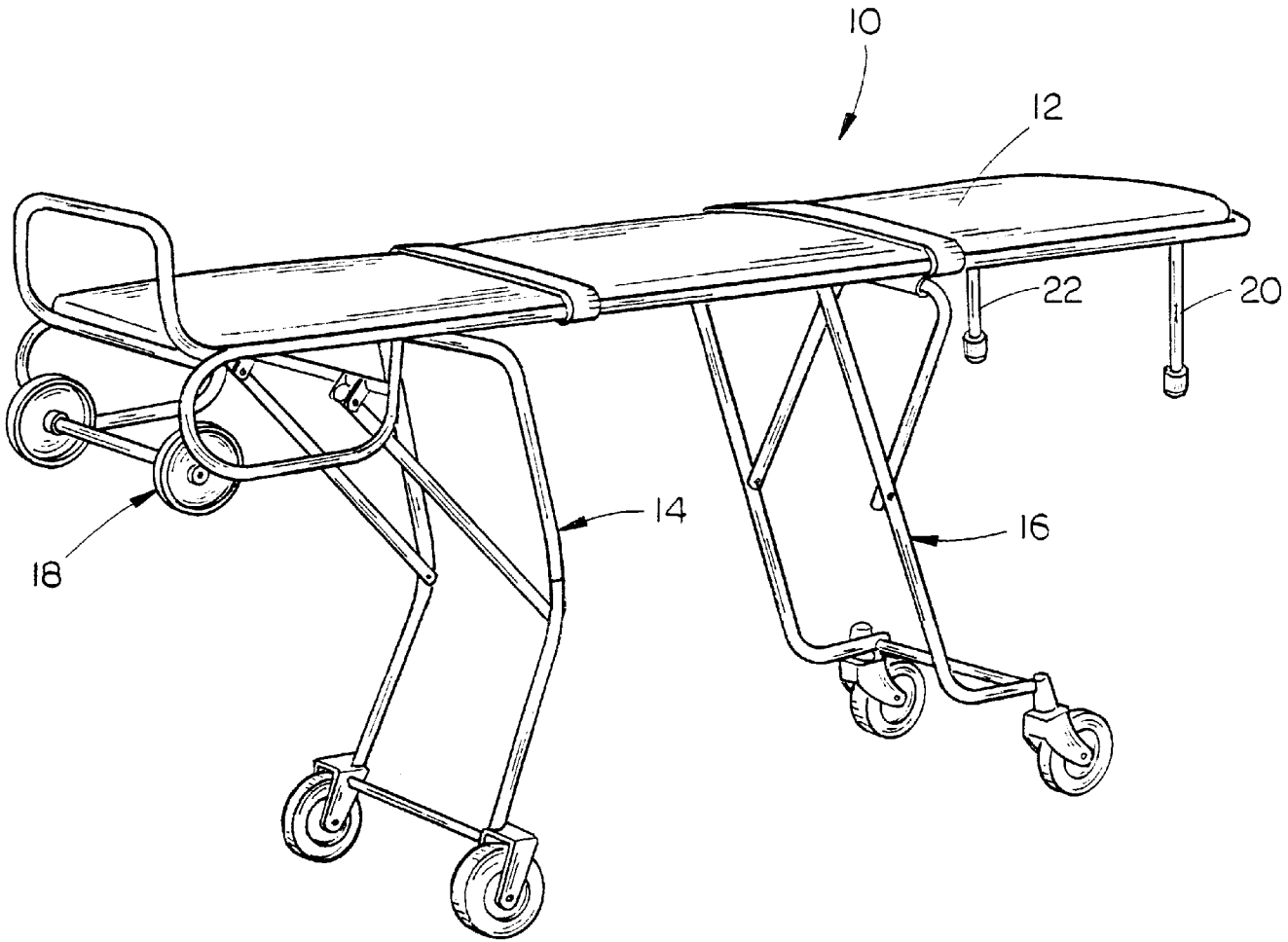
FIG. 1 is a perspective view of a mortuary cot having the post tips of this invention mounted thereon.
Figure 3:
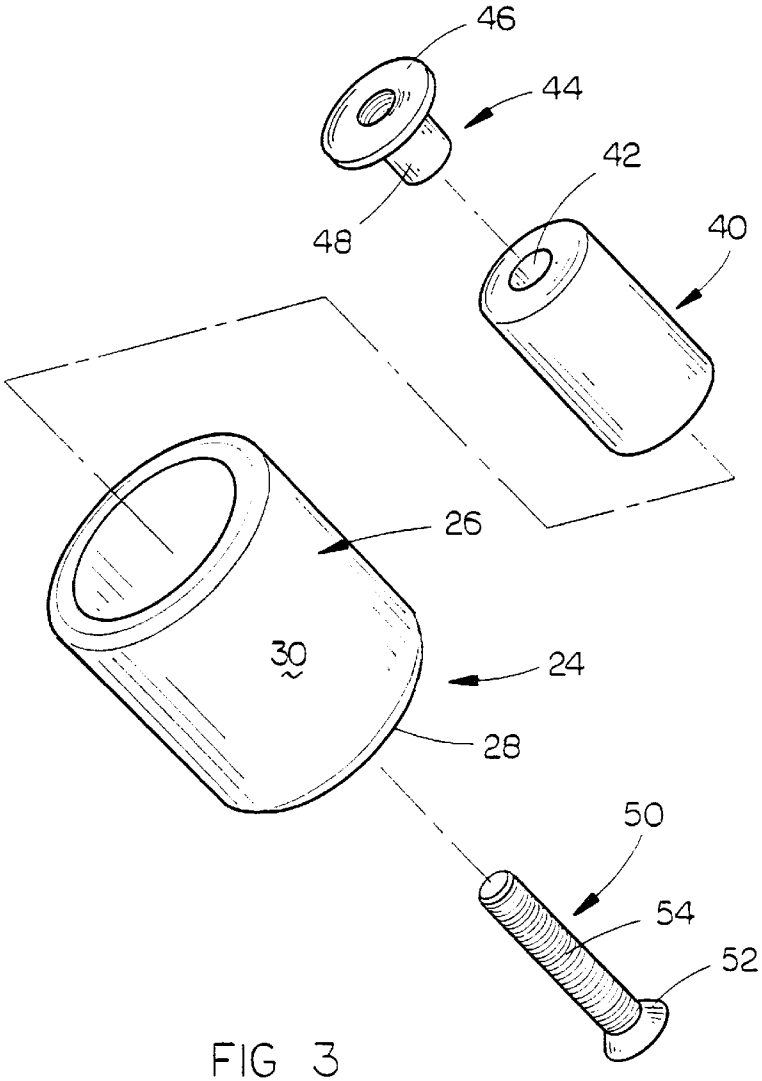
FIG. 3 is an exploded perspective view of the cot post tip.
Figure 2:
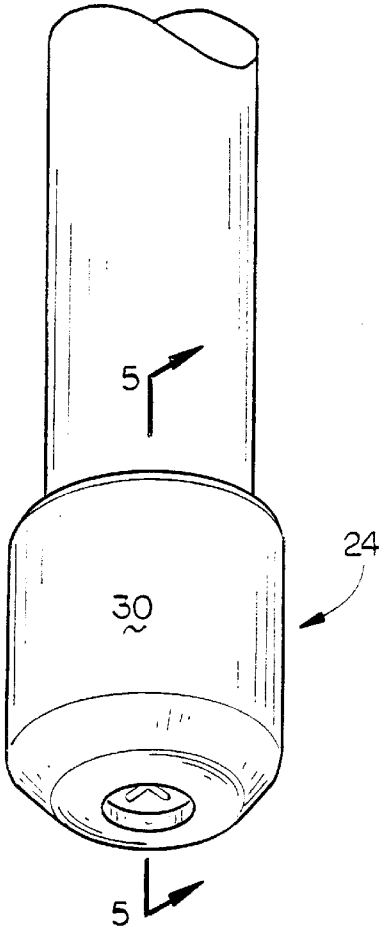
FIG. 2 is a perspective view illustrating the cot post tips installed on a cot post.
Figure 5:
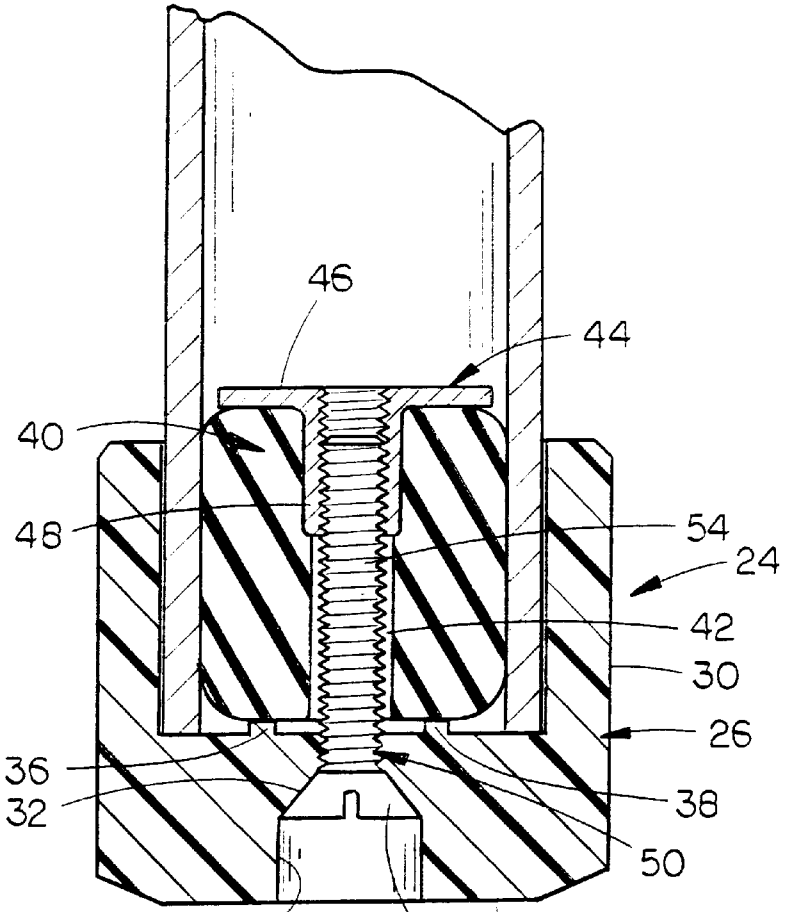
FIG. 5 is a vertical sectional view illustrating the cot post tip of this invention as seen on lines 5—5 of FIG. 2.

A cot post tip is described for use on each of the downwardly extending cot posts of a mortuary cot. Each of the cot post tips includes a cup-shaped member comprised of a durable Delrin 500 material having an open upper end and a lower end. The lower end of the tip has an opening extending upwardly therethrough to receive a threaded bolt or screw extending upwardly therethrough. A cylindrical deformable plug is initially loosely positioned in the lower end of the cap-shaped member and has an elongated bore extending therethrough which receives the threaded bolt. A plug compression member is threadably mounted on the upper end of the threaded bolt so that threadable rotation of the bolt with respect to the compression member will cause the cylindrical plug to be deformed into frictional engagement with the interior wall surface of the lower end of the cot post so that the tip will remain on the cot post. The Delrin construction of the tip ensures that the lower end of the cot post will not cut or wear through the tip.

It is therefore a principle object of the invention to provide an improved cot post tip for a mortuary cot.

Still another object of the invention is to provide a cot post tip for a mortuary cot which is easy to install thereon and which eliminates maintenance problems.

Still another object of the invention is to provide a cot post tip for a mortuary cot which is economical of manufacture, durable in use and refined in appearance.

These and other objects will be obvious to those skilled in the art.

DESCRIPTION OF THE PREFERRED EMBODIMENTS

The numeral 10 refers generally to a mortuary cot of conventional design which includes a bed 12 supported by at least a pair of wheeled folding leg assemblies 14 and 16. An auxiliary wheel assembly 18 is provided at one end of the cot 10 and a pair of downwardly extending cot posts 20 and 22 are provided at the other end of the cot 10. The cot posts 20 and 22 are hollow and include inner and outer wall surfaces.

Figure 4:
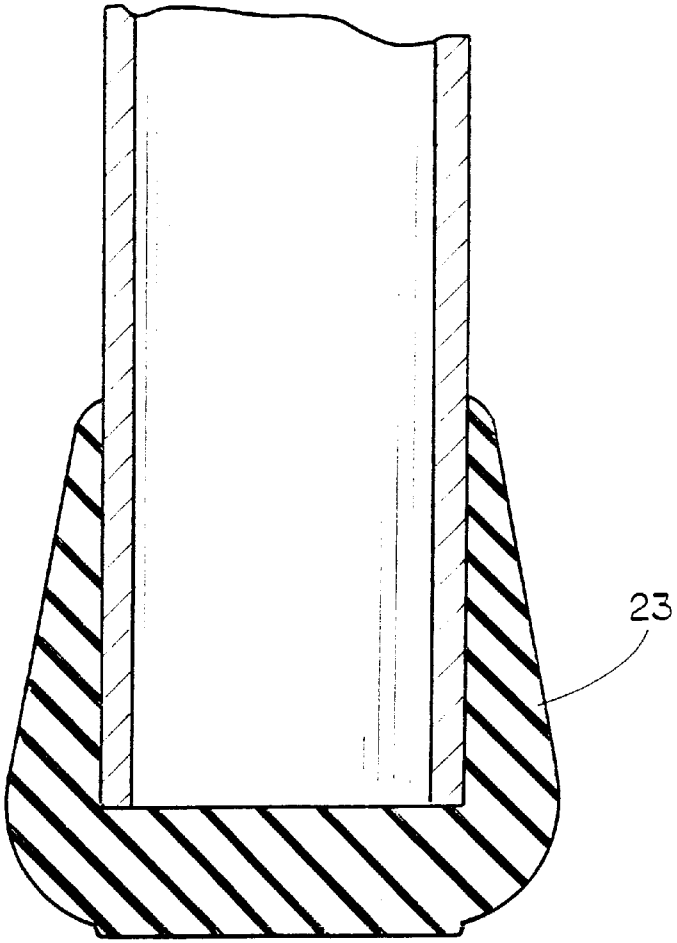
FIG. 4 (PRIOR ART)
FIG. 4 is a vertical sectional view of a prior art device.

Heretofore, the lower ends of the cot posts 20 and 22 had cane tips 23 or the like mounted thereon as seen in FIG. 4. In the prior art devices, the posts 20 and 22 wore or cut through the cane tips 23 which required constant maintenance and/or replacement.

In use, the body to be retrieved is placed on the bed 12 and the folding leg assemblies 14 and 16 are utilized to transport the body from the point of retrieval to the mortuary vehicle. The cot 10 is moved inwardly into the rear of the vehicle with the folding leg assemblies 14 and 16 folding automatically as the cot is moved into the vehicle. During the positioning of the cot into the vehicle, the auxiliary wheels 18 support one end of the cot. When the cot has been completely placed in the vehicle, the posts 20 and 22 support the other end of the cot.

The numeral 24 refers to the improved cot post tip of this invention which is designed to replace the prior art cane tips mounted on the lower ends of the posts 20 and 22. Cot post tip 24 includes a cup-shaped member 26 including a lower end 28 and a cylindrical portion 30 extending upwardly therefrom. The lower end 28 of member 26 is provided with an opening 32 formed therein having an enlarged outer or lower end portion 34. The upper or inside surface of lower end 28 of tip 24 includes at least a pair of stand-off members 36 and 38. Tip 26 is preferably comprised of a Delrin 500 material having a Rockwell hardness of M94, R120.

Tip 24 also includes a deformable cylindrical plug 40 having an elongated bore 42 extending therethrough between the upper and lower ends thereof. The diameter of plug 40 is such that it may be received by the interior of the associated cot post. Tip 24 also includes a plug compression member 44 having a washer-like member 46 at its upper end and an internally threaded collar 48 extending downwardly therefrom which is received in the upper end of the elongated bore 42. As seen in the drawings, bolt 50 including a head portion 52 and an externally threaded portion 54 extends upwardly through the bore 32 with the head portion 52 being received in the enlarged diameter portion 34. The externally threaded portion 54 of bolt 50 extends through bore 42 and is threadably received by the collar 48.

The method of installing the tip 24 on either of the posts 20 or 22 is as follows. The compression member 44 is positioned on the upper end of the plug 40 so that the collar 48 is positioned in the upper end of the bore 42. Bolt 50 is extended through the opening 32 and the bore 40 and is partially threaded to the collar 48 until the lower end of plug 40 engages the stand-off members 36 and 38. The assembly is then installed on the lower end of the cot post so that the cylindrical wall portion 26 embraces the exterior surface of the lower end of the cot post and so that the plug 40 is received in the interior of the cot post. Threadable rotation of the bolt 50 with respect to the compression member 44 causes the plug 40 to be compressed between the washer-like element 46 and the stand off members 36 and 38 thereby causing the plug 40 to be deformed outwardly into frictional engagement with the interior wall surface of the cot post so that the cot post is securely and positively maintained on the cot post. The frictional engagement of the plug 40 with the members 36 and 38 prevents rotation of plug 40 during the threadable movement of bolt 50. If it is necessary to remove and replace the post tip, the bolt 50 is threadably rotated with respect to the compression member 44, in a direction opposite to the tightening direction, so that the plug 40 is permitted to assume its pre-deformed position so that the tip 24 may be easily removed from the cot post. The Delrin construction of the cup-shaped member 24 ensures that the post tip will have a long life inasmuch as the lower end of the cot post will not cut or wear through the Delrin material of the member 24.

Thus it can be seen that the invention accomplishes at least all of its stated objectives.

I claim:

1. In combination:

a mortuary cot including at least a pair of downward, extending hollow cot posts having a lower end and interior and exterior wall surfaces;

a cot post tip mounted on the lower end of each of said cot posts;

each of said cot post tips comprising:

(a) a cup-shaped member having a lower end which is positioned at the lower end of the associated cot post and a hollow, cylindrical wall portion extending upwardly therefrom which embraces the lower end of the associated cot post; said lower end of said cup-shaped member having both an inner surface and an opening extending therethrough;

(b) an externally threaded fastener extending upwardly through said opening in said lower end of said cup-shaped member;

(c) a deformable cylindrical plug having upper and lower ends with an elongated bore formed therein which extends between the upper and lower ends thereof; said plug being positioned in the interior of the associated cot post at the lower end thereof; said fastener being received by said elongated bore;

(d) and a plug compression member; said plug compression member including a flat washer-shaped portion positioned at the upper end of said deformable cylindrical plug, and an internally threaded collar extending downwardly from said washer-shaped portion into said elongated bore of said plug for threadable connection to said fastener whereby threadable rotation of said fastener with respect to said plug compression member will cause said plug to be deformed into frictional engagement with the interior wall surface of the associated cot post to maintain said cup-shaped member on said cot post.

2. The combination of claim 1 wherein said cup-shaped member is comprised of a low friction, synthetic resin such as the one sold under the trademark of Delrin.

3. The combination of claim 1 wherein said fastener includes a head and a threaded shank portion and wherein the lower end of said opening in said lower end of said cup-shaped member is provided with an enlarged portion for reception of said fastener head and a recessed portion to prevent contact between said fastener head and a surface on which said tip rests.

4. The combination of claim 1 wherein said cup-shaped member is provided with a stand-off means at the inner surface of said lower end thereof for engagement with the lower end of said plug.

5. In combination:

a hollow tubular member having a lower end and interior wall surface;

a tip mounted on said lower end of said tubular member, said tip comprising a cup-shaped member having a lower end which is positioned at said lower end of said tubular member and a hollow, cylindrical wall portion extending upwardly therefrom which embraces said lower end of said tubular member; said lower end of said cup-shaped member having an opening extending therethrough; an externally threaded fastener extending upwardly through said opening in said lower end of said cup-shaped member; a deformable cylindrical plug having upper and lower ends with an elongated bore formed therein which extends between the upper and lower ends thereof; said plug being positioned in the interior of the tubular member at the lower end thereof; a plug compression member, said plug compression member including a flat washer-shaped portion positioned at the upper end of said deformable cylindrical plug, and an internally threaded collar extending downwardly from said washer-shaped portion into said elongated bore of said plug and threadably connected to said fastener whereby threadable rotation of said fastener with respect to said plug compression member will cause said plug to be deformed into frictional engagement with the interior wall surface of said tubular member to maintain said cup-shaped member on said tubular member.

6. The combination of claim 5 wherein said cup-shaped member is comprised of a low friction, synthetic resin such as the one sold under the trademark of Delrin.

7. The combination of claim 5 wherein said fastener includes a head and a threaded shank portion and wherein the lower end of said opening in said lower end of said cup-shaped member is provided with an enlarged portion for reception of said fastener head and a recessed portion to prevent contact between said fastener head and a surface on which said tip rests.

8. The combination of claim 5 wherein said cup-shaped member is provided with stand-off means at the inner surface of said lower end thereof for engagement with the lower end of said plug.

* * * * *